US005560110A

United States Patent [19]

Haines

[11] Patent Number: 5,560,110

[45] Date of Patent: Oct. 1, 1996

[54] HOLE PUNCH FOR RACEWAY

[76] Inventor: Melvin D. Haines, 3582 Annsbury Rd., Grove City, Ohio 43123

[21] Appl. No.: 247,272

[22] Filed: May 23, 1994

[51] Int. Cl.[6] ..... B26F 1/02

[52] U.S. Cl. ..... 30/363; 30/358

[58] Field of Search ..... 30/363, 366, 368, 30/355, 357, 358, 315; 83/684, 685, 686

[56] References Cited

U.S. PATENT DOCUMENTS

| | | | |
|---|---|---|---|
| 1,418,474 | 6/1992 | Rosenberg | 30/363 |
| 1,785,215 | 12/1930 | Sponable | 30/363 |
| 1,890,955 | 12/1932 | Spengler | 30/363 |
| 3,296,905 | 1/1967 | Killaly | 83/685 X |
| 3,350,781 | 11/1967 | Bender | 30/363 X |
| 3,381,376 | 5/1968 | Ames | 30/358 |
| 3,721,144 | 3/1973 | Yamamori | 83/685 |
| 5,377,415 | 1/1995 | Gibson | 30/363 |

FOREIGN PATENT DOCUMENTS

| | | | |
|---|---|---|---|
| 771518 | 11/1967 | Canada | 83/685 |

*Primary Examiner*—Eugenia Jones
*Attorney, Agent, or Firm*—Sidney W. Millard; Kremblas, Foster, Millard & Pollick

[57] ABSTRACT

A punch for punching rectangular holes in clamshell-shaped raceways for the mounting of receptacles allowing connection to appropriate cables running through the raceway. The punch includes a reciprocable punch having four generally triangular-shaped teeth projecting toward a die mounted in a die block. Each tooth is located at a corner of a rectangular-shaped cutting punch. The open raceway slides into the punching apparatus between the punch and the die to a stop pre-adjusted for hole location and the four teeth penetrate the wall of the raceway and the sloping cutting edges of the teeth cut the rectangular shape of the desired size.

1 Claim, 2 Drawing Sheets

HOLE PUNCH FOR RACEWAY

FIELD OF THE INVENTION

This invention relates to an apparatus and process for punching holes in the sidewalls of raceways at a particular size and location on the job site where the raceway is assembled and cables installed.

BACKGROUND OF THE INVENTION

Modular work sites in a modern office environment include a plurality of office cubicles set apart by divider panels. The divider panels often do not extend from floor to ceiling but often have sound absorbing elements incorporated therein. The idea is to provide each worker with a defined working area with a feeling of a little privacy but to have the panels easily relocated and permitting easy expansion and contraction of the work space.

As a part of the modular work station concept, plastic or metal raceways have been built into the panels to receive electrical and computer cable for computers, electrical appliances, and the like. Often the raceways are pre-punched in certain locations or have weakened sections which may be punched out easily for the mounting of receptacles where equipment may be attached for power and access. The problem which is created, and which is solved by this invention, is that the receptacle openings are not always in the right location nor necessarily the right size for the particular receptacle needed in the work environment.

This invention solves that problem by providing a portable punch which may be taken to the assembly site when the modular cubicles are being assembled which allows the assembling personnel to punch holes in the plastic raceways at a location and of a size which is suitable for the desired operation.

Products on the market and supplied by certain assemblers comprised a circular punch and a knife. The assembling personnel installing the cables and outlets were expected to punch a circular hole the location site and then cut the appropriate size of hole and make it rectangular to accommodate the receptacle to be mounted therein.

To provide a more convenient and faster apparatus, a punching apparatus was designed to punch rectangular holes through the wall of the raceway at a desired location and at the desired size.

SUMMARY OF THE INVENTION

The punch used in punching round holes includes a pair of handles pivoted together at one end with a round punch pivotally mounted on the upper handle to pass through an opening in the lower handle and penetrate a die mounted in a die block as an extension of the lower handle. This structure has been modified by removing the circular punch and providing replaceable apparatus for a rectangular punch for mounting on the punch end of the shaft pivotally connected to the upper handle.

The punch is uniquely designed having four generally triangular-shaped teeth projecting from a base toward a correspondingly shaped die mounted on a die block bolted to the lower handle. The four teeth are located with their peaks at the four corners of the rectangle. Straight line sloping cutting edges extend from the peak of each tooth and slope toward the base in a direction along each side edge of the rectangular pattern.

To facilitate easy sequential uses of the punch during operations where there is a pattern of use in a plurality of cubicles, an adjustable stop is mounted on the die block to reciprocate back and forth from the die to allow an adjustment of the stop. The stop serves as an abutment for the edge of the clamshell-shaped raceway. This allows the assembling personnel to measure the location of the desired hole to be punched and then the stop can be set to that spacing between the die and the stop so that the edge of the raceway can be placed into abutment with the stop which automatically gives the right location.

Similarly, the size of the desired hole to be punched is dictated by the size of the receptacle to be installed. That can be ascertained prior to the time the hole is punched and an appropriate punch may be selected along with a corresponding die.

Objects of the invention not understood from the above will become clear from a review of the drawings and the description of the preferred embodiment which follows.

DETAILED DESCRIPTION OF THE PREFERRED EMBODIMENT

Figure 1:
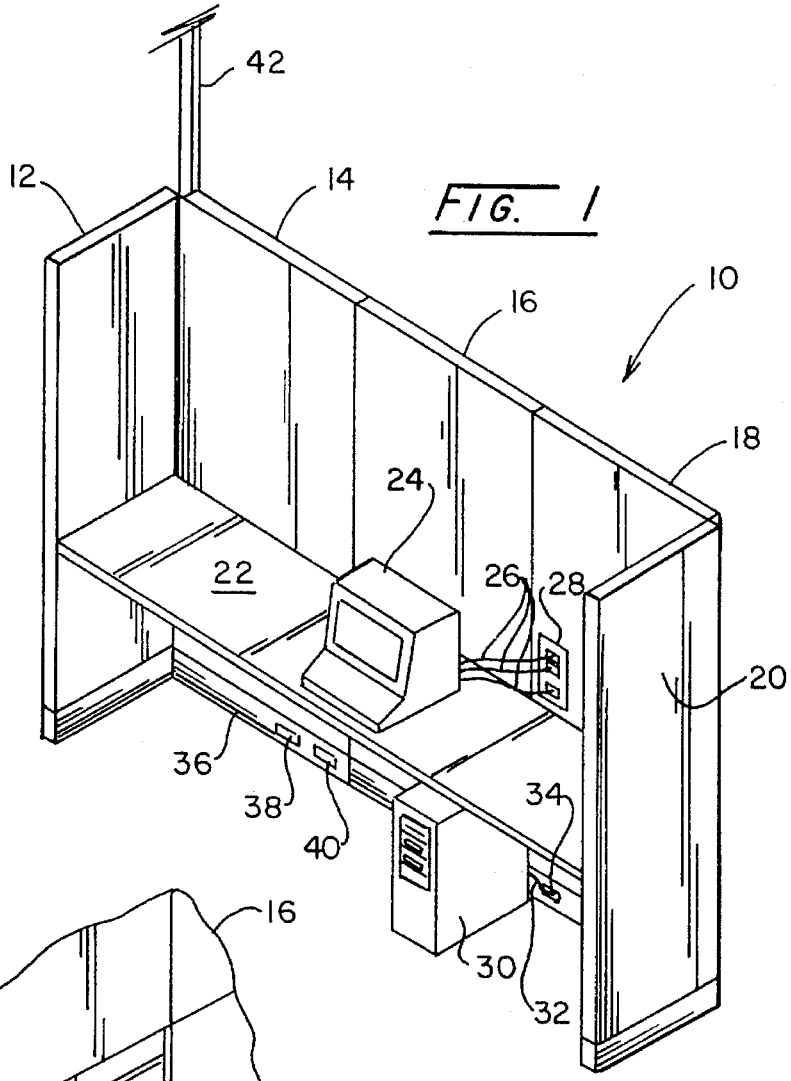
FIG. 1 is a perspective view of a modular work station.

Referring particularly to FIG. 1, a modular work station 10 is constructed of a plurality of easily assembled panels 12, 14, 16, 18 and 20. A desk 22 bridges between end panels 12 and 20 and supports a word processing unit 24. The word processing unit is connected by cables 26 to outlets in receptacles 28.

Located beneath the desk is a cabinet 30 which may be associated in function with the word processor through a cable 32. Cable 32 runs to a receptacle 34 which is mounted in one wall of a cable raceway 36. To the left of cabinet 30, as illustrated in FIG. 1, cable raceway 36 has two other receptacle openings 38, 40 which may or may not be pre-punched by the manufacturer.

In conventional modular construction electrical and other cable access is supplied through the floor or through the ceiling and the cables are directed through vertical raceways 42 to the transverse raceways 36.

Figure 2:
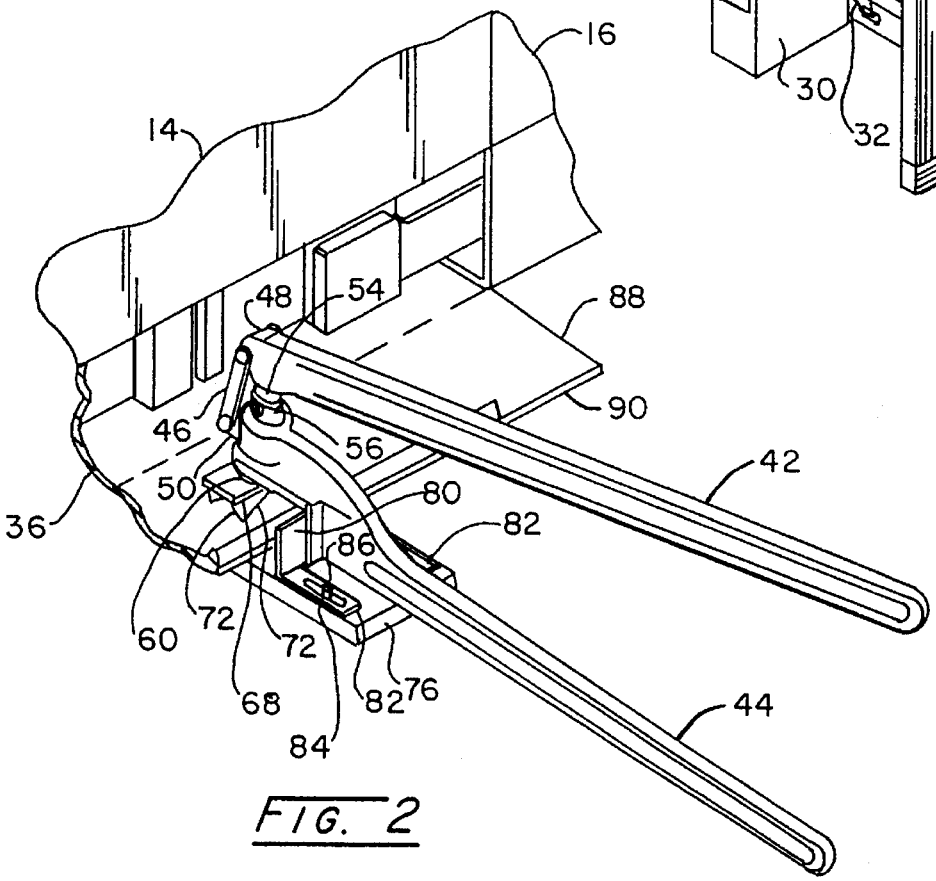
FIG. 2 is a fragmentary perspective view of a plastic raceway open to allow the punching apparatus of this invention to punch a hole in its sidewall.

Looking now to FIG. 2, to facilitate the installation of cables and other apparatus desirably mounted within the raceway 36, the plastic sidewalls of the raceway are formed of some conventional thermoplastic materials which is not relevant to this invention except to say that such materials are tough and relatively impact resistent because they encounter continual abuse and impacts from vacuum cleaners, feet, etc. The raceway is formed of a generally clamshell-type structure where each side may flip down to allow access by a worker and when flipped back up it snaps into position with its adjacent panel 14, 16.

Often there is a desire to punch an additional or several additional receptacle openings in the sidewall of the clamshell-shaped raceway. This is a project which is performed at the work site, most often after the modular work station 10 has been assembled. Accordingly, a punching apparatus is provided including an upper handle 42 pivotally secured to a lower handle 44 by a pair of pivotal links 46. The two links are pivotally secured to the handles through forwardly extending lugs 48 and 50. Links 46 are secured to lugs 48 and 50 by pins, studs or bolts 52 which project through holes in the lugs and the links.

Figure 3:
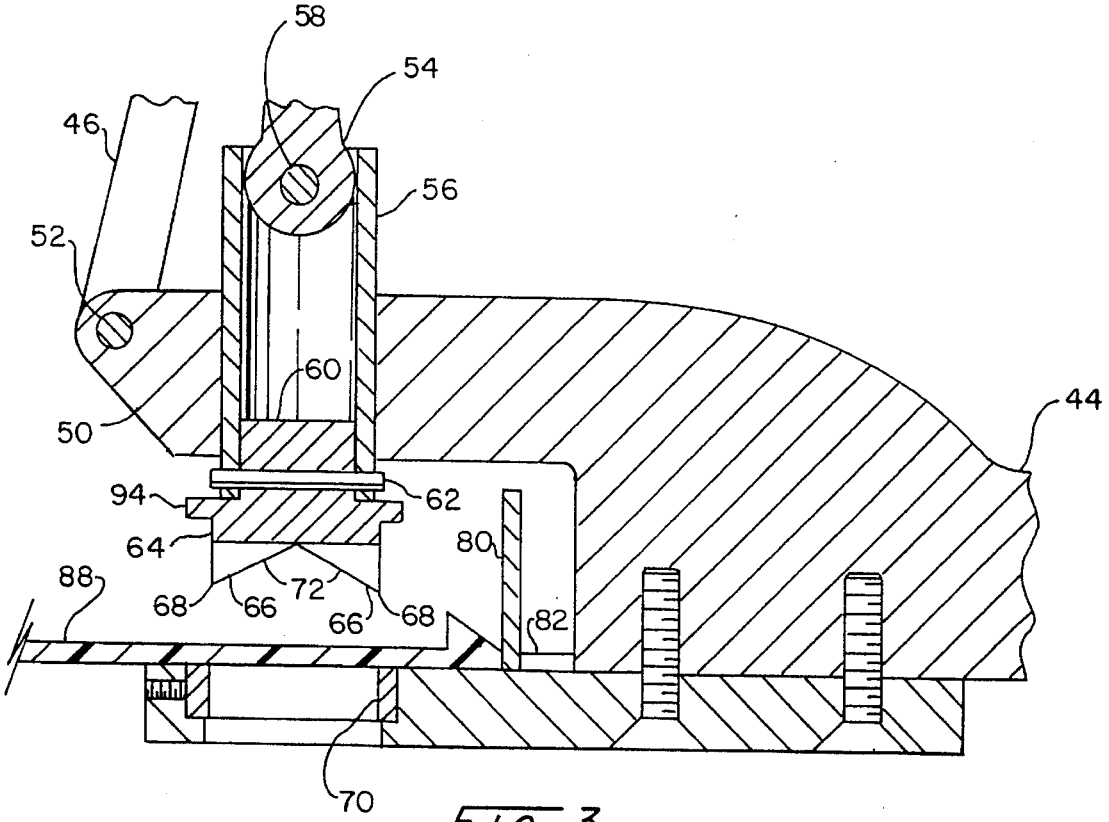
FIG. 3 is a fragmentary sectional view of the punch and die area of the punching apparatus of this invention with the plastic sidewall of the raceway in position to be punched.
Figure 4:
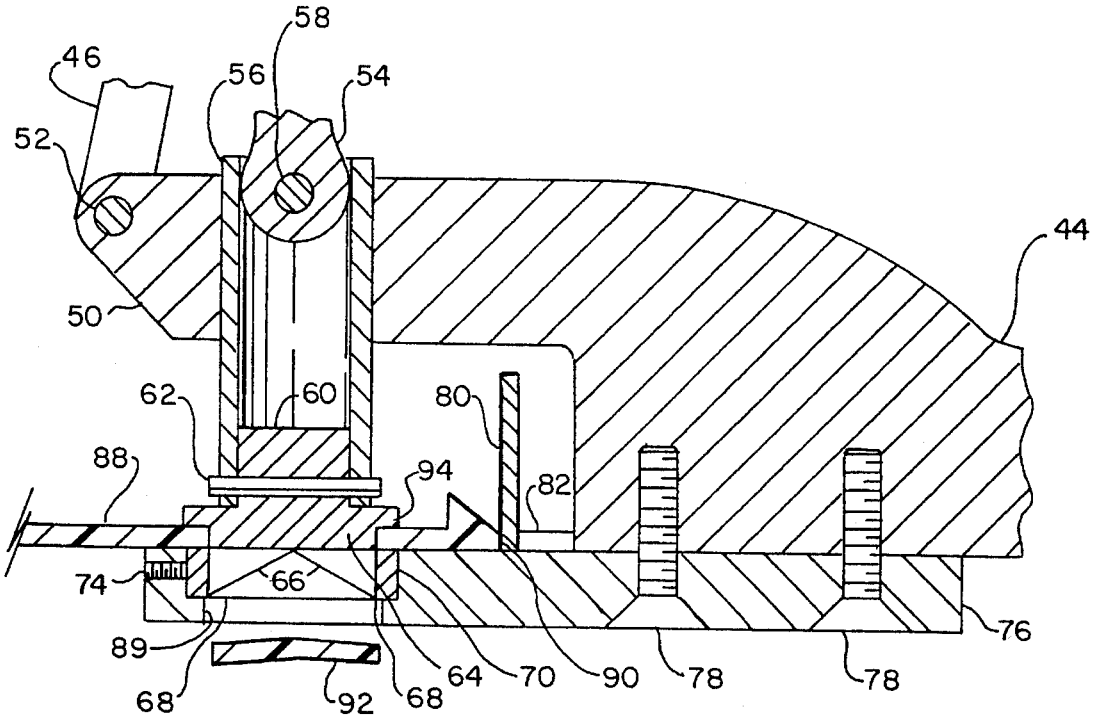
FIG. 4 is a fragmentary sectional view similar to FIG. 3 but with the punch depressed punching the hole through the sidewall of the raceway.

Handle 42 has a downwardly extending mounting lug 54, best seen in FIGS. 3 and 4, which is pivotally secured to a shaft 56 by a pin, stud or bolt 58.

At the lower end of shaft 56 is a punch 60. The punch is held in position on the lower end of shaft 56 by a removable pin 62.

Punch 60 includes a base 64 having four downwardly projecting teeth 66 which are of generally triangular pyramid shape with the peak 68 of each pyramid projecting away from the base toward a die 70. The edges of the die and the punch define a rectangular shape with the peak 68 of one tooth being at each corner of the rectangle. Straight line cutting edges 72 slope at an angle from each peak along the edge of the rectangle in both directions from each peak toward the base 64, such that the cutting edges 72 terminate about half way along each edge from the peaks 68.

During the course of research and experimental use with punches of various designs it was discovered that curved cutting edges as opposed to the straight line cutting edges 72 caused breakage of pins 52, links 46 or handles 42, 44 because of the length of the cutting surface. It was only discovered after several failures that the sharp straight line cutting edges 72 were the most effective. It is preferred that the angle of the cutting edges, measured from a horizontal, slope toward the base from the peaks at an angle of about 20–30 degrees. An angle less than that creates too long a cutting area with the resultant breakage and an angle greater than that tends to weaken the peak of the teeth with more breakage of the punch.

In order to change the punch 60 to accommodate a different size for a different size receptacle opening, the pin 62 is simply removed and a different size punch 60 is installed. Obviously, a different size die 70 is also necessary. The die is removable by retracting a set screw 74.

The die block 76 is shown attached to lower handle 44 by screws 78. It is clear that it could be formed integral with handle 44 or welded thereto.

Slidably mounted on the upper surface of die block 76 as best seen in FIG. 2 is a stop 80. The stop is integral with a pair of legs 82 having slots 84 therein. Bolts 86 are tightened when stop 80 is adjusted to the proper location to maintain it in position.

In operation, the worker determines that a new receptacle opening must be punched in sidewall 88 of raceway 36 and the clamshell is popped open. The worker determines the size and location of the desired receptacle opening and mounts an appropriate punch on shaft 56 and die in the support aperture 89. Then the worker measures the distance from the closest edge of the hole to the side edge 90 of sidewall 88. Next the stop 80 is adjusted to its proper location such that its forward face is approximately the same distance from the severing edge of die 70 as is the closest edge of the desired hole from sidewall edge 90. Then sidewall edge 90 slides into the punching apparatus between punch 60 and die 70 until it is in abutting relationship with the forward face of stop 80. Handle 42 is depressed driving shaft 56 downward and punch 60 through the plastic material into die 70 where it expels a slug 92 of the plastic material.

A transversely extending flange 94 projects from base 64 and it serves two purposes. It provides a downward limitation in the travel of punch 60 and it prevents the sidewall of the raceway from slipping past the punch to surround shaft 56. Disengagement of the raceway from the punch after the sidewall has slipped upward beyond the punch is extremely difficult and flange 94 was designed into the punch after unsuccessful efforts without the flange. After the punching process the raceway is completed, the raceway is manually pressed toward the die as the punch is retracted and easy separation results.

Having thus described the apparatus in its preferred embodiment, it will be clear to those having ordinary skill in the art, that certain modifications may be made without departing from the spirit of the invention. It is not intended that the invention be limited by the words used in describing the same, nor the drawings illustrating the same. Rather it is intended that the invention be limited only by the scope of the appended claims.

I claim:

1. Apparatus for punching holes in cable raceways comprising, an upper handle and a lower handle, each handle having an end with a hole therethrough, the two ends being secured together by a link and two rods, said link having two ends and holes in each link end which are parallel to each other, each rod passing through one of said link holes and one of said handle holes, the upper handle including a downwardly extending mounting lug, a shaft extending through an opening in said lower handle spaced inwardly from the end of the lower handle, said lug being pivotally connected to said shaft at one end of the shaft, a rectangular punch being removably secured to said shaft at the other end of said shaft, said punch having a shape and size in cross-section which is greater than said opening thereby preventing the passage of said punch through said opening, a die block secured to said lower handle, said block having a die support aperture aligned with said punch, a die having a rectangular opening therethrough, said die being mounted in said aperture to receive the penetration of said punch, said punch including a base with four triangular shaped teeth, each tooth having two sharp straight line cutting edges aligned with said rectangular opening in said die, each cutting edge extending from said base at an angle in the range 20–30 degrees to a peak of its respective tooth projecting toward said die, the peak of each tooth being located in alignment with a respective one of the four corners of said die opening and thereby defining a rectangular shape, each cutting edge terminating at said base remote from said peak at a location not greater than the distance halfway between two peaks located at the corners joined by one edge of said rectangular shape, a flange projecting transversely from said base to minimize the penetration of said punch into said die, an adjustable stop slidably mounted on said die block for abutting the edge of material to be punched, thereby locating the hole to be punched at a predetermined distance from the abutting edge, and said die block being releasably secured to said lower handle.

* * * * *